United States Patent [19]

Aldorf

[11] Patent Number: 4,507,214

[45] Date of Patent: Mar. 26, 1985

[54] RARE EARTH HALIDE GREASE COMPOSITIONS

[75] Inventor: Henry E. Aldorf, Paris, France

[73] Assignee: Union Oil Company of California, Los Angeles, Calif.

[21] Appl. No.: 548,224

[22] Filed: Nov. 2, 1983

[51] Int. Cl.[3] ..... C10M 5/04

[52] U.S. Cl. ..... 252/18; 252/25; 252/58

[58] Field of Search ..... 252/18, 25, 58

[56] References Cited

U.S. PATENT DOCUMENTS 3,787,320 1/1974 Erdmann et al. ..... 252/54
3,933,657 1/1976 Seni et al. ..... 252/33.6
4,034,133 7/1977 Fleck et al. ..... 428/64

OTHER PUBLICATIONS

Harold E. Sliney, Rare Earth Fluorides and Oxides—An Exploratory Study of Their Use as Solid Lubricants at Temperatures to 1,800° F. (1,000° C.), NASA TN D-5301, 1969.

*Primary Examiner*—Jacqueline V. Howard
*Attorney, Agent, or Firm*—Dean Sandford; Gregory F. Wirzbicki; Cleveland R. Williams

[57] ABSTRACT

Lubricating compositions are disclosed which comprise a major amount of an oil of lubricating viscosity, thickened to a grease consistency with an oil thickener and a minor amount of a rare earth halide.

29 Claims, No Drawings

RARE EARTH HALIDE GREASE COMPOSITIONS

BACKGROUND OF THE INVENTION

1. Field of the Invention

This invention relates to lubricating grease compositions and more particularly to improved lubricating grease compositions containing additives such as the rare earth halides.

2. Description of the Prior Art

Over the years, the development of a satisfactory lubricating grease composition for use under extreme pressure, high temperature and high speed conditions has received widespread attention. Consequently, numerous additives have been proposed to enhance the physical and chemical properties of grease compositions. Additives which have been proposed for producing such grease compositions include lead-sulfur additives, heavy metal sulfide additives, particularly molybdenum disulfide additives, soluble phosphorus-sulfur additives, and, more recently, oil insoluble phosphorus-oil soluble sulfur additives. These additives, although providing some effectiveness under extreme pressure conditions, have certain disadvantages, both functional and economical. For example, molybdenum disulfide, which is generally accepted as an additive for producing extreme pressure lubricants and greases, is relatively expensive and increases the cost of manufacturing said lubricants and greases. Also, with additives such as those mentioned above which contain sulfur, there is the possibility of additive breakdown and degradation under severe and/or extreme conditions, resulting in the release of sulfur. Metal parts in contact with grease compositions containing sulfur in a free or combined state can, in time, cause serious corrosion to metal parts.

U.S. Pat. No. 3,453,209 discloses solid lubricating compositions for use with metal-forming dyes, for example, presses, forges, drop hammers and the like. Suitable lubricants disclosed by the reference are the zinc, molybdenum and cadmium sulfides, tungsten disulfide, graphite and inorganic fluorides, such as calcium fluoride.

U.S. Pat. No. 3,492,229 relates to jet engine lubricants, heat transfer fluids and hydraulic fluids having oxidation resistance properties. These lubricants contain an alkali metal compound or an antimony, bismuth or lanthanum compound, such as lanthanum oxide.

U.S. Pat. No. 3,525,690 discloses grease compositions which comprise a base fluid of hexafluoropropylene epoxide and a thickener selected from ammeline, boron nitride particles and a fluorocarbon resin or particle.

U.S. Pat. No. 3,684,711 relates to hydraulic fluids, heat transfer fluids and lubricants which contain a complex alkali metal organophosphorus compound or a complex rare earth metal organophosphorus compound as an oxidation inhibitor.

U.S. Pat. No. 4,034,133 discloses a magnetic recording element which includes a base and a coating upon the surface of the base, which comprises magnetic particles dispersed in a polymeric binder and a lubricant. The lubricant is described as a trifluoride of cerium, lanthanum, praseodymium, neodymium and samarium.

As can readily be determined from the above, there is an ongoing effort to develop new lubricant compositions.

Accordingly, it is an object of the present invention an improved grease composition.

Another object of the present invention is to provide a grease composition having an improved load carrying ability.

Yet another object of the present invention is to provide a lubricating composition having improved extreme pressure properties.

These and other objects are accomplished according to the present invention by adding a rare earth metal halide to a lubricating composition.

SUMMARY OF THE INVENTION

The present invention resides in a lubricating composition comprising a major amount of a lubricating grease and a minor amount of a rare earth metal halide.

DETAILED DESCRIPTION OF THE INVENTION

The lubricating compositions of this invention contain an oil of lubricating viscosity, thickened to a grease consistency with a thickener, and a rare earth metal halide.

The lubricating oils which form the major component of the grease compositions herein may be any of the oils having lubricating characteristics which are suitable for use in lubricating compositions. Thus, mineral oils and synthetic oils which have a viscosity within the range of about 35 to 200 SUS at 210° F. are suitable for use in this invention.

Suitable mineral oils are derived from distillate lubrication oils which have an initial boiling point within range of about 350° F. to about 475° F., an endpoint in the range of about 500° F. to about 1100° F., and a flash point not lower than 110° F.

The preferred oil herein is natural oil or or shale oil. Lubricants derived from oil shale are particularly desirable for use herein. Oil shale is typically found as a compact sedimentary rock, generally laminated, that contains little or no oil but does contain organic material, derived from aquatic organisms or waxy spores and pollen grains, which is convertible to oil by heat. Crude shale oil, in combination with water, gas and spent shale containing a carbonaceous residue and mineral matter, is formed by the pyrolysis of oil shale. The hydrocarbons of shale oil are highly unsaturated, resembling the products of thermal cracking of petroleum, as would be expected because of the pyrolytic origin of shale oil. Once the shale oil is extracted, it is subjected to conventional hydrotreating procedures to produce a variety of hydrocarbon products, including lubricants.

Synthetic lubricating oils useful herein are those oils derived from a product of chemical synthesis (man-made oils). Typical examples of such compositions include the polyglycol fluids (i.e., polyalkylene glycol); silicones which consist of a silicone-oxygen polymer chain to which are attached hydrocarbon branches composed of either alkyl or phenyl groups; phosphates; polyphenyl esters; synthetic hydrocarbons and various esters of organic acids and alcohols.

The polyalkylene glycol lubricating oils suitable for use herein preferably are derived from the reaction product of the appropriate alkylene oxides. The alkylene moiety of the above compositions have a carbon chain of from about 1 to about 10 carbon atoms, preferably from 2 to about 7 carbon atoms and a molecular weight within the range of from about 200 to about 2,000, preferably from about 200 to about 1,000, most preferably from about 200 to about 800. Representative examples of suitable polyalkylene glycols include, polyethylene glycol, polypropylene glycol, polyisopropylene glycol, polybutylene glycol and the like.

Synthetic lubricating oils derived from hydrocarbons are generally of two types, namely, dialkylated benzene and polymerized alpha-olefins. Dialkylated benzene herein is formed from the condensation product of the appropriate alkyl compound and has a carbon chain from about 5 to about 50 carbon atoms, preferably from about 8 to about 20 carbon atoms; and a molecular weight of from about 200 to about 1,500, preferably from about 300 to about 700. Representative compounds include di-n-decylbenzene, n-decyl-n-tetradecylbenzene, and n-nonyl-n-dodecylbenzene.

Alpha-olefins suitable for use in preparing lubricating oils herein are characterized by the formula $RCH{=}CH_2$ wherein R is a radical selected from the group of hydrogen and alkyl radicals having from about 4 to about 18 carbon atoms, preferably from about 6 to about 10 carbon atoms, and having a molecular weight of from about 80 to about 300, preferably from about 100 to about 200. Typical compounds include 1-octene, 1-decene and 1-dodecene.

Phosphates suitable for use herein as synthetic lubricating oils are the phosphate esters having the formula $O{=}P(OR)_3$, wherein R is aryl or alkyl having from about 4 to about 20 carbon atoms, preferably from 6 to about 10 carbon atoms, and have a molecular weight within the range of from about 200 to about 1,000, preferably from about 300 to about 550. Representative compounds include trioctyl phosphate, tricresyl phosphate and dicresyl methyl phosphate.

Esters of organic acids which are suitable for use herein as synthetic lubricating oils preferably are selected from organic acids having carbon chains of from $C_4$ to $C_{40}$ carbon units. Organic acids which may be reacted with the alcohols herein include caproic, decanoic, sebacic, laurel, oleic, stearic, palmitic, etc. Likewise, alcohols herein may be derived from either natural or synthetic origin, for example, pentaerythritol, trimethylolpropane, amyl, 2-ethyl-hexanol or laurel alcohol, may be used to form the desired ester. The esters are formed using conventional methods. For example, the esters may be prepared by reaction of the desired alcohol with the desired acid, acid anhydride or acid halide using conventional reaction conditions and techniques.

Silicone polymer oils may also be employed, preferably those having viscosities in the range of from about 70 to 900 SUS at 100° F. Suitable compounds of this type include dimethyl silicone polymer, diethyl silicone polymer, methyl cyclohexyl silicone polymer, diphenyl silicone polymer and methyltolyl silicone polymer.

The lubricating oil preferably comprises from about 60 to about 96 weight percent, and more preferably from about 70 to about 90 percent of the lubricating composition. The lubricating oil is conveniently thickened to a grease consistency with an oil thickener. Generally, two types of oil thickeners are used to form grease compositions: soaps and/or clays.

A soap-base thickening agent as used herein is defined as metal soaps of fatty acids which are capable of providing a stable gel structure to lubricating base oils. Fatty acids which are suitable for use herein are those fatty acids which have from about 10 to about 40 carbon atoms ($C_{10}$ to $C_{40}$), preferably from about 15 to about 30 carbon atoms ($C_{15}$ to $C_{30}$). The term soap-base is intended to include conventional metal soaps, complex soaps, mixed base soap greases and includes the following soap thickeners:

Metal bases:

aluminum, barium, calcium, lithium, sodium, lead, strontium and magnesium.

Mixed bases:

sodium-calcium, sodium-barium, calcium-aluminum, sodium-aluminum, magnesium-aluminum, lithium-barium, lithium-aluminum, lithium-calcium, lithium-bentonite, and barium-bentonite.

Clay bases:

bentonite, kaolinite, montmorillonite, illite, silicone, monazite and hectorites.

Soaps:

hydrated calcium soap, hydrated aluminum soap, hydrated barium soap, hydrated lithium soap, hydrated sodium soap, hydrated strontium soap, complex-aluminum soap and complex-barium soap.

Metal complex bases:

complex-lithium soap, lithium-barium complex, lithium soap-lithium acetate, lithium soap-lithium azelate complex, magnesium soap complex, lead soap complex, sodium soap-sodium acetate complex, sodium soap-sodium acrylate complex, sodium-barium complex and strontium-calcium acetate complex.

A particularly desirable group of soaps which are suitable for use in the above bases includes oleates, stearates, hydroxystearates, azelates, acrylates, sulfonates, acetates and benzoates, and mixtures thereof. In addition, polyurea may be used as an oil thickener herein.

It should be noted that the above metal bases and clay bases may be mixed together, with each other or with the above soaps forming complex mixtures of the respective bases.

Generally, the oil thickener is mixed with a lubricating oil in an amount sufficient to impart a grease-like consistency to the lubricating oil. The oil thickener is preferably added to the lubricating oil at a concentration of from about 0.1 to about 30 weight percent, preferably from about 3 to about 20 weight percent of the lubricating composition.

The extreme pressure additives which impart enhanced load-carrying characteristics to the lubricating compositions herein comprises a rare earth metal halide. Rare earth metals which are suitable for use include lanthanum, cerium, praseodymium, neodymium, promethium, samarium, europium, gadolinium, terbium, dysprosium, holmium, erbium, thulium, ytterbium, lutetium and yttrium. Halides which are suitable for use in forming the rare earth metal compounds include chlorine, fluorine, bromine and iodine with fluorine being the preferred halide. Preferred rare earth metal halides are members selected from the group consisting of cerium trifluoride, lanthanum trifluoride, praseodymium trifluoride, neodymium trifluoride and samarium trifluoride and mixtures thereof. An especially preferred rare earth, metal halide suitable for use herein is cerium trifluoride. The cerium trifluoride may be used in either a pure grade or a technical grade. Cerium trifluoride (technical grade) normally has the following approximate impurities: $BaSO_4$ (10 wt. %), $SrCO_3$ (3.1 wt. %), $CaCO_3$ (1.45 wt. %), Si and Fe (0.1 to 1 wt. %), Mg and Al ($<0.01$ wt. %). It should be noted that these impurities do not adversely affect the extreme pressure property of cerium trifluoride.

The rare earth, metal halides normally have a particle size of from about 0.1 to about 60 microns, preferably from about 0.2 to about 30 microns, most preferably from about 0.1 to about 20 microns. Rare earth metal halides which fall within these particle size ranges are more easily dispersed in the lubricating grease compositions, forming a homogeneous mixture which is stable for prolonged periods of time. The rare earth, metal halides comprise a minor amount of the lubricating composition, typically from about 0.1 to about 20 weight percent, preferably from about 1 to about 10 weight percent, and most preferably from about 3 to about 7 weight percent. The rare earth, metal halides herein are conveniently admixed with the grease compositions using conventional techniques and procedures.

If desired, the additives described herein may be employed in conjunction with other additives commonly used in lubricating oils. Thus, there may be added to the lubricating oil compositions of this invention rust inhibitors, tackifiers, corrosion and oxidation inhibitors and other extreme pressure agents. The only requirement to adding additional additives herein is that they be compatible with the other components of the lubricating oil composition.

The rare earth metal halides herein may additionally be incorporated into a lubricating oil as a lubricating oil suspension. When the rare earth metal halides are used as a lubricrating oil suspension, conventional suspending agents, emulsion agents or suspension stabilizers are employed in conjunction with the rare earth metal halides to ensure tht a homogeneous mixture of lubricating oil and rare earth metal halide results.

The rare earth metal halides herein enhance the extreme pressure properties of lubricating oils and greases. However, it should be noted that the rare earth metal halides have the greatest utility as an extreme pressure agent for grease compositions used to lubricate wheelbearings.

The invention will be further described with reference to the following examples, which are provided to illustrate and not limit the invention.

EXAMPLES I TO IV

Cerium trifluoride is tested for extreme pressure (E.P.) properties in a grease composition comprising 7 weight percent lithium 12-hydroxy stearate and 93 weight percent SAE 40 motor oil (750 SUS at 100° F.) by determining the four-ball E.P. weld load, Amontons' law limit values and the initial scuffing load for the composition.

The weld load in kilograms force is determined by the modified ASTM:D 2596, four ball E.P. test. In this test, a steel ball under a constant force or load rotates at a speed of 1450 RPM against three steel balls held in a stationary position in the form of a cradle. The temperature of the balls is maintained at 167° F. and the rotating ball is subjected to successively higher loads for 10 seconds until the four balls weld together.

The Amontons' law limit gives the range of normal loads beyond which the friction force of a body no longer behaves linearly with the applied force on a body. Amontons' law limit is considered as the operating limit for normal bearings. Amontons' law limit is expressed as the load in Kg force on each of the three bottom balls in accordance the procedure of the modified ASTM:D 2266, four-ball wear test where the balls are rotated at 1450 rpm at a temperature of 167° F.

The initial scuffing load is the load at which severe wear (or damage) of the test specimens occurs in the four-ball test and is determined as the load on each of the three stationary balls. The results are summarized in Table 1 below:

TABLE 1

| Example | I | II | III | IV |
|---|---|---|---|---|
| Cerium Trifluoride Wt. % | 0 | 1 | 3 | 5 |
| Four Ball Weld Load (Kg f) | 150 | 180 | 220 | 230 |
| Amontons' Law Limit (Kg f) | 20 | 20 | 24 | 24 |
| Initial Scuffing Load (Kg f) | 23 | 37 | 38 | 40 |

The above data prove that cerium trifluoride imparts enhanced extreme pressure properties to lithium base grease.

EXAMPLES V TO VII

The procedure of Examples I to IV is followed to compare the initial scuffing load of cerium trifluoride, molybdenum disulfide and graphite in lithium base grease (7 wt. % lithium 12-hydroxy stearate and 93 wt. % SAE 40 motor oil). The results are summarized in Table 2 below:

TABLE 2

| | Initial Scuffing Load (Kg. Force) | | |
|---|---|---|---|
| Example | V | VI | VII |
| Wt. % | 0 | 3 | 7 |
| $CeF_3$ | 24 | 34 | 41 |
| $MoS_2$ | 24 | 41 | 36 |
| Graphite | 24 | 20 | 24 |

The above data prove that the initial scuffing load of cerium trifluoride is substantially better than molybdenum disulfide or graphite at the 7 weight percent concentration in lithium base grease.

EXAMPLES VIII TO X

Cerium trifluoride is tested and compared with molybdenum disulfide in a wheelbearing test, wheelbearing life test and water washout test in lithium base grease.

The wheelbearing and wheelbearing life tests utilize a front wheel hub and spindle assembly in accordance with the procedures disclosed in ASTM:D-1263 and ASTM:D-3527, respectively, but differ in the conditions of the test. In the wheelbearing test, the hub assembly is rotated for six hours at 600 rpm and a spindle temperature of 219.2° F. is maintained. The grease and oil leakage is measured at the end of the test.

In the wheelbearing life test, the hub is rotated at 1,000 rpm and a spindle temperature of 302° F. is maintained wherein a twenty-hour on, four-hour off operating cycle is utilized The test is automatically terminated when the sample deteriorates and causes the drive motor torque to increase to four times the steady-state torque. The wheelbearing life of a grease is expressed as the accumulated on-cycle life.

The water washout test is conducted in accordance with the procedure of ASTM:D-1264. The test involves packing a four gram sample of the grease to be tested in a ball bearing. The ball bearing is then inserted into a housing and rotated at 600± 30 rpm. Water at a temperature of 175° F. is made to impinge on the bearing house at a rate of 5 ml/sec. The amount of grease washed out in one hour is determined as a measure of grease resistance to water washout.

The results are summarized in Table 3 below:

TABLE 3

| | Example | | |
|---|---|---|---|
| | VIII Control | IX $CeF_3$ (3 wt. %) | X $MoS_2$ (3 wt. %) |
| Wheelbearing Test (g. loss) | 0.82 | 0.24 | 0.31 |
| Wheelbearing Life Test (hours to failure) | 73.1 | 98.6 | 96.4 |
| Water Washout Test (g. loss) | 0.29 | 0.16 | 0.19 |

The test data in Table 3 above prove that cerium trifluoride is superior to molybdenum disulfide as an additive for lithium base grease in the wheelbearing test, the wheelbearing life test and the water washout test.

EXAMPLES XI AND XII

A grease composition comprising 14 weight percent barium complex soap (barium acetate stearate) and 86 weight percent SAE 50 motor oil (1850 SUS at 100° F.) is mixed with cerium trifluoride (3 wt. %) and tested for extreme pressure (E.P.) properties by determining the four-ball E.P. weld load, and the scar diameter of the rotating ball in the four-ball test. The results are summarized in Table 4 below:

TABLE 4

| Example | XI | XII |
|---|---|---|
| Barium Complex Soap | 100 wt. % | 97 wt. % |
| Cerium Trifluoride | 0' | 3 wt. % |
| Four-Ball Test (ASTM:D-2596) Weld Load, Kg | 126 | 200 |
| Scar Diameter, Inches | 0.020 | 0.020 |

The above data prove that cerium trifluoride increases the load carrying ability of barium complex soap.

Obviously, many modifications and variations of this invention, as hereinbefore set forth, may be made without departing from the spirit and scope thereof, and therefore only such limitations should be imposed as are indicated in the appended claims.

I claim:

1. A lubricating composition comprising a major amount of a lubricating grease and a minor amount of a rare earth metal halide.

2. The lubricating composition defined in claim 1 wherein the lubricating grease is a mineral oil in combination with an oil thickener.

3. The lubricating composition defined in claim 2 wherein the oil thickener is a member selected from the group consisting of lithium soap, barium soap, aluminum soap, lithium complex soap, barium complex soap, aluminum complex soap, polyurea, $C_{10}$ to $C_{40}$ fatty acids, calcium soap, sodium soap, strontium soap, silicone polymer oils, montmorillonite clay, bentonite clay and magnesium bentonite clay and mixtures thereof.

4. The lubricating composition defined in claim 1 wherein the rare earth metal is a member selected from the group consisting of lanthanum, cerium, praseodymium, neodymium, promethium, samarium, europium, gadolinium, terbium, dysprosium, holmium, erbium, thulium, ytterbium, lutetium and yttrium and mixtures thereof.

5. The lubricating composition defined in claim 1 wherein the halide is a member selected from the group consisting of chlorine, fluorine, bromine and iodine and mixtures thereof.

6. A lubricating grease composition comprising a major amount of an oil of lubricating viscosity, an amount of a soap or clay sufficient to thicken the oil to a grease consistency and a sufficient amount of a rare earth metal halide to impart enhanced load carrying, extreme pressure and anti-wear properties to said grease composition.

7. The lubricating grease composition defined in claim 6 wherein the soap or clay is a member selected from the group consisting of lithium oleate, lithium stearate, lithium hydroxystearate, lithium azelate, barium stearate, barium oleate, barium acetate, barium sulfonate, aluminum stearate, aluminum benzoate, calcium acetate, sodium acrylate, montmorillonite clay, bentonite clay and magnesium bentonite clay and mixtures thereof.

8. The lubricating grease composition defined in claim 6 wherein the rare earth metal is a member selected from the group consisting of lanthanum, cerium, praseodymium, neodymium, promethium, samarium, europium, gadolinium, terbium, dysprosium, holmium, erbium, thulium, ytterbium and lutetium and mixtures thereof.

9. The lubricating grease composition defined in claim 6 wherein the halide is a member selected from the group consisting of chlorine, fluorine, bromine and iodine and mixtures thereof.

10. A lubricating grease composition comprising a homogeneous mixture of:

(A) from about 60 to about 96 weight percent of an oil of lubricating viscosity;

(B) from about 0.1 to about 30 weight percent of an oil thickener; and (C) from about 0.1 to about 20 weight percent of a rare earth metal halide.

11. The lubricating grease composition defined in claim 10 wherein the oil thickener is a member selected from the group consisting of lithium soap, barium, soap, aluminum soap, lithium complex soap, barium complex soap, aluminum complex soap, $C_{10}$ to $C_{40}$ fatty acids, calcium soap, sodium soap, strontium soap, silicone polymer oils, montmorillonite clay, bentonite clay and magnesium clay and mixtures thereof.

12. The lubricating grease composition defined in claim 10 wherein the rare earth metal is a member selected from the group consisting of lanthanum, cerium, praseodymium, neodymium, promethium, samarium, europium, gadolinium, terbium, dysprosium, holmium, erbium, thulium, ytterbium, and yttrium and mixtures thereof.

13. The lubricating grease composition defined in claim 10 wherein the halide in the rare earth metal halide is a member selected from the group consisting of chlorine, fluorine and bromine and mixtures thereof.

14. A lubricating composition comprising a major amount of a lubricating grease and a minor amount of a rare earth metal halide selected from the group consisting of cerium trifluoride, lanthanum trifluoride, praseodymium trifluoride, neodymium trifluoride and samarium trifluoride and mixtures thereof.

15. The lubricating composition defined in claim 14 wherein the lubricating grease comprises a major amount of an oil of lubricating viscosity and a minor amount of an oil thickener selected from the group consisting of lithium soap, barium soap, aluminum complex soap, $C_{10}$ to $C_{40}$ fatty acids, calcium soap, montmorillonite clay, bentonite clay and magnesium bentonite clay and mixtures thereof.

16. A lubricating grease composition comprising a major amount of a lubricating grease and a minor amount of cerium trifluoride.

17. The lubricating grease composition defined in claim 16 wherein the lubricating grease contains a minor amount of a thickening agent selected from the group consisting of lithium soap, lithium complex soap, barium soap, barium complex soap, bentonite clay and magnesium bentonite clay and mixtures thereof.

18. A lubricating grease composition comprising a major amount of a lubricating oil thickened to a grease consistency with a thickener selected from the group consisting of aluminum soap, lithium soap, barium complex soap, aluminum complex soap, lithium complex soap and bentonite clay and mixtures thereof and from about 0.1 weight percent to about 20 weight percent cerium trifluoride.

19. A lubricating grease composition comprising a major amount of a lubricating oil thickened to a grease consistency with a lithium soap, or a lithium complex soap or a mixture thereof, and from about 0.1 weight percent to about 20 weight percent cerium trifluoride.

20. A lubricating grease composition comprising a major amount of a lubricating oil thickened to a grease consistency with a barium soap, or a barium complex soap or a mixture thereof and from about 0.1 weight percent to about 20 weight percent cerium trifluoride.

21. A method of lubricating wheelbearings which comprises contacting a wheelbearing assembly with a lubricating composition comprising a major amount of a lubricating grease and a minor amount of a rare earth metal halide.

22. The method defined in claim 21 wherein the lubricating grease comprises a lubricating oil in combination with an oil thickener.

23. The method defined in claim 22 wherein the oil thickener is a member selected from the group consisting of lithium soap, barium soap, aluminum soap, lithium complex soap, barium complex soap, aluminum complex soap, polyurea, $C_{10}$ to $C_{40}$ fatty acids, calcium soap, sodium soap, strontium soap, silicone polymer oils, montmorillonite clay, bentonite clay and magnesium bentonite clay and mixtures thereof.

24. The method defined in claim 21 wherein the rare earth metal is a member selected from the group consisting of lanthanum, cerium, praseodymium, neodymium, promethium, samarium, europium gadolinium, terbium, dysprosium, holmium, erbium, thulium, ytterbium, lutetium and yttrium and mixtures thereof.

25. The method defined in claim 21 wherein the halide is a member selected from the group consisting of chlorine, fluorine, bromine and iodine and mixtures thereof.

26. A method of lubricating wheelbearings which comprises packing a wheelbearing assembly with a lubricating grease composition comprising a major amount of an oil of lubricating viscosity, an amount of an oil thickener sufficient to thicken the oil to a grease consistency and a sufficient amount of a rare earth metal halide to impart enhanced load carrying, extreme pressure and anti-wear properties to said grease composition.

27. The method defined in claim 26 wherein the oil thickener is a member selected from the group consisting of lithium oleate, lithium stearate, lithium hydroxystearate, lithium azelate, barium stearate, barium oleate, barium acetate, barium sulfonate, aluminum stearate, aluminum benzoate, calcium acetate, sodium acrylate, montmorillonite clay, bentonite clay and magnesium bentonite clay and mixtures thereof.

28. The method defined in claim 26 wherein the rare earth metal is a member selected from the group consisting of lanthanum, cerium praseodymium, neodymium, promethium, samarium, europium, gadolinium, terbium, dysprosium, holmium, erbium, thulium, ytterbium and lutetium and mixtures thereof.

29. The method defined in claim 26 wherein the halide is a member selected from the group consisting of chlorine, fluorine, bromine and iodine and mixtures thereof.

* * * * *